US005406874A

United States Patent [19]

Witchel

[11] Patent Number: 5,406,874

[45] Date of Patent: Apr. 18, 1995

[54] MELAMINE SHEET GUITAR

[76] Inventor: Jim J. Witchel, 42729 Suburban St., Queen Creek, Ariz. 85242

[21] Appl. No.: 999,713

[22] Filed: Dec. 31, 1992

[51] Int. Cl.[6] ..... G10D 3/00

[52] U.S. Cl. ..... 84/291; 84/452 R

[58] Field of Search ..... 84/275, 291, 452 R

[56] References Cited

U.S. PATENT DOCUMENTS

| | | | |
|---|---|---|---|
| 3,699,836 | 10/1972 | Glasser | 84/291 |
| 3,722,345 | 3/1973 | Dopera | 84/291 |
| 4,161,130 | 7/1979 | Lieber | 84/267 |
| 4,185,534 | 1/1980 | Cove | 84/291 |
| 4,192,213 | 3/1980 | Steinberger | 84/293 |
| 4,313,362 | 2/1982 | Lieber | 84/267 |
| 4,320,684 | 3/1982 | Podunavac | 84/291 |
| 4,334,452 | 6/1982 | Morrison, III et al. | 84/1.16 |
| 4,359,923 | 11/1982 | Brunet | 84/267 |
| 4,408,516 | 10/1983 | John | 84/275 |
| 4,836,076 | 6/1989 | Bernier | 84/275 |
| 4,873,907 | 10/1989 | Decker, Jr. et al. | 84/291 |
| 4,916,995 | 4/1990 | Soler et al. | 84/291 |
| 4,951,543 | 8/1990 | Cipriani | 84/298 |
| 4,955,274 | 9/1990 | Stephens | 84/275 |
| 4,969,381 | 11/1990 | Decker, Jr. et al. | 84/291 |
| 5,125,312 | 6/1992 | Fishman et al. | 84/291 |

*Primary Examiner*—Michael L. Gellner
*Assistant Examiner*—P. Stanzione
*Attorney, Agent, or Firm*—Don J. Flickinger; Jordan M. Meschkow; Robert A. Parsons

[57] ABSTRACT

A stringed instrument having a neck coupled to a hollow body portion, the hollow body portion being constructed primarily utilizing synthetic resin laminate sheets.

25 Claims, 2 Drawing Sheets

FIG. 1
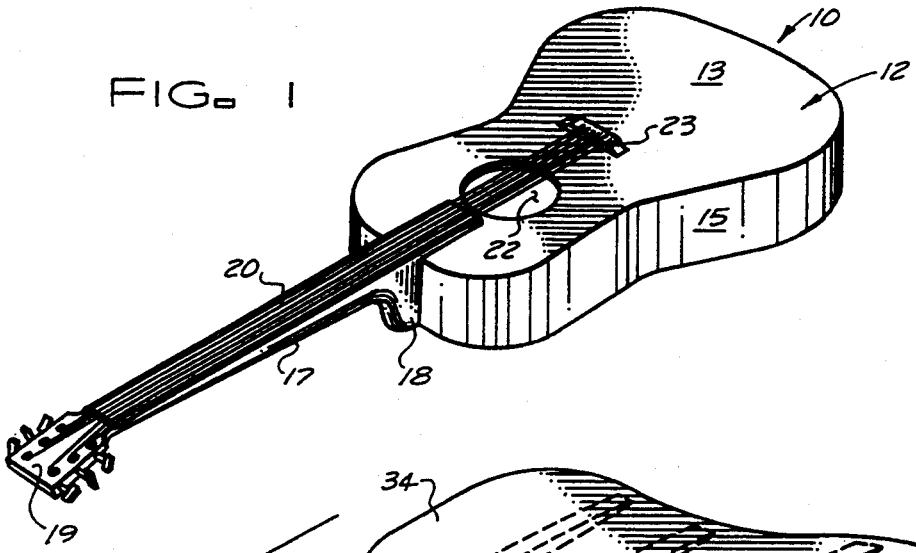
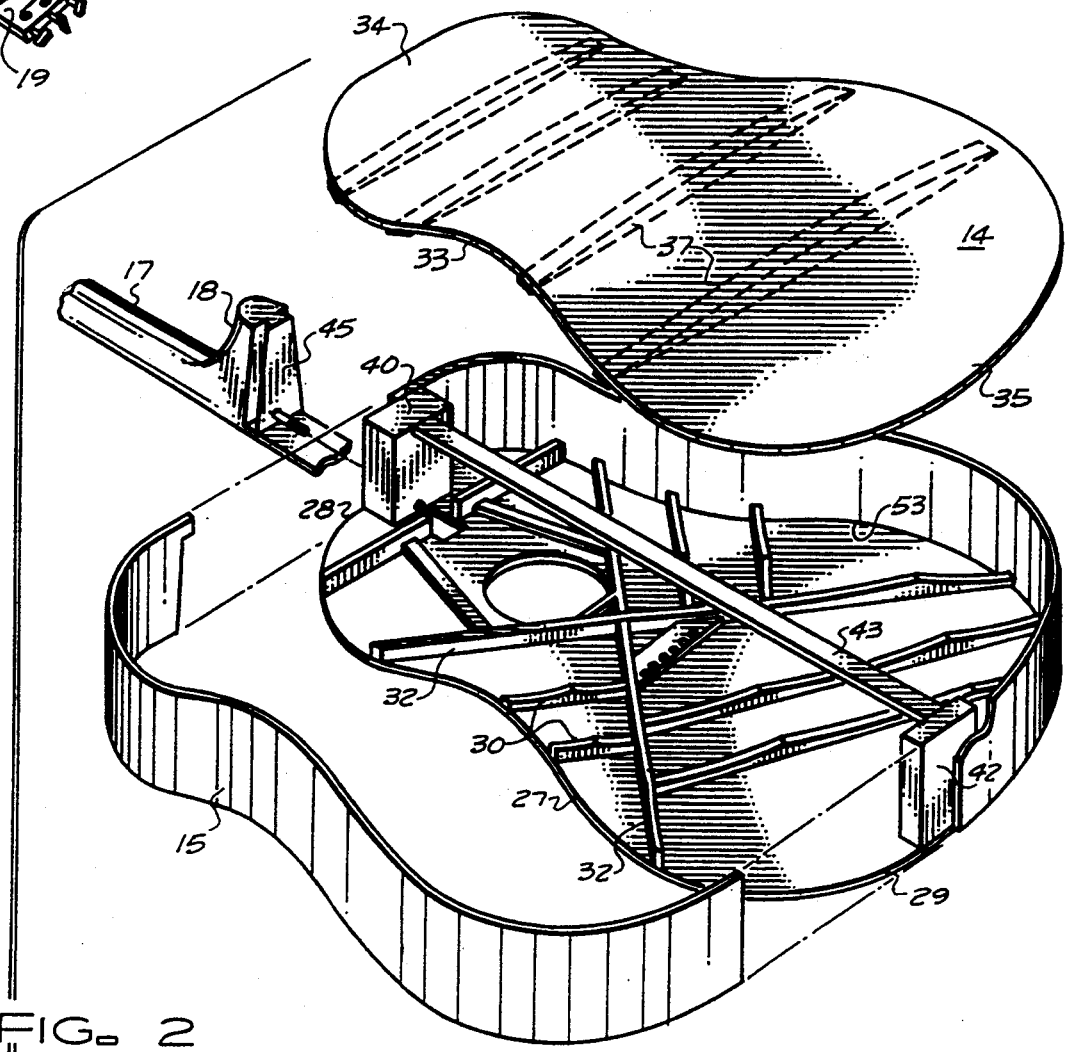
FIG. 2

MELAMINE SHEET GUITAR

BACKGROUND OF THE INVENTION

1. Field of the Invention

This invention relates to stringed musical instruments.

More particularly, the present invention relates to stringed musical instruments which have a hollow body portion.

In a further and more specific aspect, the present invention relates to the aforementioned instruments fabricated utilizing melamine impregnated resins impressed over phenolic craft layers.

2. Prior Art

Traditionally, hollow bodied stringed instruments, such as traditional acoustic guitars, are made almost entirely of wood. At the present time, string instruments with quality sound characteristics are still constructed substantially of wood.

While exceptional in beauty and sound quality, wood instruments tend to be quite expensive, and generally fragile. Instruments constructed of wood are inherently vulnerable to the elements, particularly humidity, moisture and heat. The curing, selection and storage cf choice woods to be used in musical instruments are considerations which contribute to the generally high cost of quality sounding instruments. The thin wooden panels prove generally unforgiving of mistreatment and an inadvertent blow may result in a permanently impaired instrument. There have been many attempts at overcoming the problems presented by wood instruments. Molded plastic instruments have been developed in an attempt to reduce costs and increase durability of instruments traditionally constructed of wood. Instruments constructed of molded plastic tend to be inexpensive to produce in bulk and are difficult to damage due to the strength and resiliency of plastic. However, instruments made of molded plastic typically do not display the acoustical qualities of a wooden instrument. Further, molded plastic instruments lend themselves best to mass production techniques of unchanging design because of the cost involved in preparation of new molds.

Finally, some effort has been directed towards instruments employing acoustic panels formed by a complex layering of materials. Exemplary is the use of oriented graphite fiber material embedded in a resin matrix, and the use of woven polymers. Significant design effort can be expended in the course of producing engineer developed acoustic panels. The cost of such effort is reflected significantly in the sales price of such instruments. These instruments attempt to provide an instrument with acoustics comparable to traditional wooden instruments, while being constructed of material better able to withstand adverse environments.

It would be highly advantageous, therefore, to remedy the foregoing and other deficiencies inherent in the prior art.

Accordingly, it is an object of the present invention to provide an improved low cost stringed instrument of high acoustic quality.

Another object of the present invention is to provide a stringed instrument having a hollow body portion utilizing little or no wooden parts.

And another object of the present invention is to provide a method for producing a relatively inexpensive stringed instrument of quality sound output.

Still another object of the present invention is to provide a method for producing a stringed instrument, the shape of which instrument is not limited by static molding techniques.

Yet another object of the present invention is to provide a hollow bodied stringed instrument comprised of elements made of melamine impregnated resins impressed over phenolic craft layers.

SUMMARY OF THE INVENTION

Briefly, to achieve the desired objects of the instant invention in accordance with a preferred embodiment thereof, provided is a stringed musical instrument having a sound box or body which is partially or wholly constructed of sheets of synthetic resin laminates. In the preferred embodiment the synthetic resin laminate is melamine impregnated resins impressed over phenolic craft layers. The melamine impregnated phenolic craft papers are those commercially available surface covering materials which are advocated for use as a decorative, protective covering for countertops, furniture and wall surfaces. Such surface covering materials are frequently found on the market under the trademark FORMICA, or CONOFLEX, or the like. The sound board, back and sidewalls of the stringed instrument which completes the body or sound box of the instrument are preferably sheets of this material.

The invention also teaches a method of constructing a hollow bodied acoustical stringed instrument using sheets of synthetic resin laminates.

BRIEF DESCRIPTION OF THE DRAWINGS

The foregoing and further and more specific objects and advantages of the instant invention will become readily apparent to those skilled in the art from the following detailed description of the preferred embodiment thereof taken in conjunction with the drawings in which:

FIG. 1 is a perspective view of a guitar, constructed in accordance with the teachings of the instant invention;

FIG. 2 is an exploded perspective view illustrating the guitar of FIG. 1;

DETAILED DESCRIPTION OF THE PREFERRED EMBODIMENT

Figure 3:
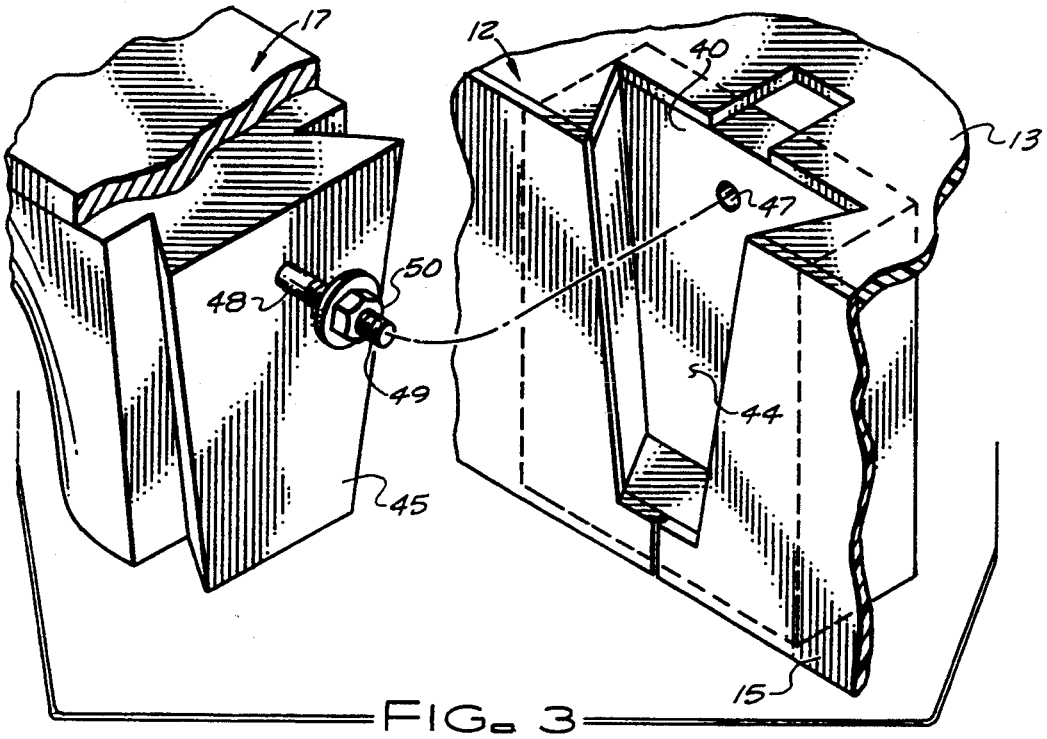
FIG. 3 is an enlarged fragmentary view in perspective, illustrating the tapered dovetail joint coupling the neck to the body of the guitar illustrated in FIG. 1.

Turning now to the drawings in which like reference characters indicate corresponding elements throughout the several views, attention is first directed to FIG. 1 which illustrates and acoustical stringed instrument, which in this preferred embodiment is a guitar generally designated 10. Guitar 10 consists of a body 12 having a sound board 13, a back 14, and a side 15 coupling sound board 13 and back 14 in a generally parallel spaced apart relationship. A neck 17 includes a heel 18 located at one end which couples neck 17 to body 12. A head 19 opposite heel 18 on neck 17 carries the tuners or tuning machines on which the ends of strings 20 are wound. Strings 20 extend from head 19 down neck 17, passing over a sound hole 22 formed in sound board 13. Strings 20 are anchored in a bridge 23 coupled to sound board 13.

Referring now to FIG. 2, the instrument of FIG. 1 may be constructed as a relatively inexpensive stringed instrument of high acoustic qualities. This may be achieved by the use of a synthetic resin laminate formed into sheets and used to construct the various elements of guitar 10. In the preferred embodiment the synthetic resin laminate material is comprised of melamine impregnated resins impressed over phenolic craft layers. Such material is commercially available in sheet stock bearing trademarks such as FORMICA, CONOFLEX, and the like. To simplify the discussion which follows, melamine impregnated resins impressed over phenolic craft papers will be hereinafter referred to as melamine sheets. Although the embodiment disclosed here will be that of a guitar, the teachings herein are applicable to all stringed instruments having a hollow body portion. Melamine sheet material comes in various designs, many of which simulate attractive and sometimes exotic wood grains. In the discussion which follows, it will be understood that the decorative surface of the melamine sheet will be oriented outward of the follow body portion of the stringed instrument.

Referring to FIG. 2, the construction of guitar is illustrated. Guitar 10 is shown with back 14 in an upward direction in order to allow viewing of the back surface of sound board 13. Sound board 13 is preferably cut from a sheet of melamine in the desired shape, having an irregular edge 27, a neck end 28 and a tail end 29. A plurality of tone bars 30 and transverse braces 32 are affixed to the back surface of sound board 13. The pattern illustrated in FIG. 2 is well-known to those skilled in the art. Alternative bracing patterns, known to those skillled in the art, may also be employed.

Still referring to FIG. 2, back 14 is preferably cut from a sheet of melamine into the desired shape, matching sound board 13 and having an irregular edge 33, and a neck end 34 and a tail end 35. Lateral braces 37 extend across the inner surface of back 14, to provide support. Lateral braces 37 are constructed and positioned in a manner well-known to those skilled in the art. Generally, during construction, a neck block 40 and a tail block 42 are adhesively affixed to back 14 proximate neck end 34 and tail end 35 respectively. Neck block 40 and tail block 42 provides support for side 15 and sound board 13. A longitudinal support 43 is adhered to lateral braces 37 of back 13 between neck block 40 and tail block 42, respectively.

Neck block 40 is provided with a dovetail groove 44 to which a dovetail tongue 45, formed in heel 18 of neck 17, may be coupled after body 12 of guitar has been fully enclosed. This will be described in greater detail in the following description.

Side 15 is preferably a substantially continuous strip cut from a melamine sheet of sufficient length to affix it to edge 33 of back 14, so as to extend vertically from back 14 as side 15. In practice, a working line may be located at the center of the length of side 15. This may then be aligned with a center line on tail block 42 with side 15 being affixed to tail block 42 at that position. It will be understood that the substantially continuous strip forming side 15 may be divided into two equal halves, as shown in FIG. 2.

Side 15 is then brought around so as to conform with edge 33 of back 14. A holding fixture may be utilized to maintain side 15 everywhere in contact with edge 33. Such holding fixtures are well-known in the art and are not here illustrated. In the simplest production facility, such a holding fixture might consist of adhesive strips employed temporarily to maintain side 15 and back 14 in contact. The ends of side 15 are adhesively fastened to neck block 40. Care must be taken in fastening side 15 to neck block 40 so as to keep dovetail groove 44 open. This is clearly illustrated in FIG. 3.

Figure 4:
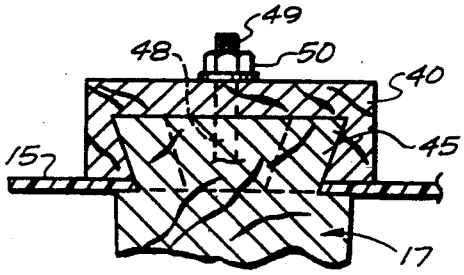
FIG. 4 is a cross-sectional top view of the tapered dovetail joint of FIG. 3.
Figure 5:
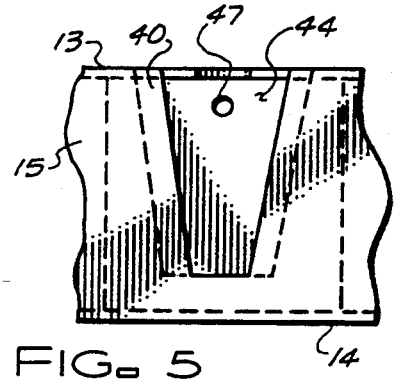
FIG. 5 is a fragmentary end view of a portion of the body, illustrating the dovetail groove formed in the neck block.

Referring to FIGS. 3–5, attachment means for affixing neck 17 to body 12 is illustrated. While in this embodiment, a dovetail groove 44 receives a dovetail tongue 45 to affix neck 17 to body 12, other methods well-known to those skilled into the art may be employed. In this embodiment, dovetail groove 44 is tapered to receive dovetail tongue 45 having a corresponding taper. The tapered shape of dovetail groove 44 and dovetail tongue 45 allows proper positioning of neck 17 with respect to body 12. A bore 47 extends through neck block 40, communicating with dovetail groove 44. A reinforcing rod 48 extending from dovetail tongue 45 of neck 17, having a threaded end 49 extends through bore 47 when dovetail tongue 45 is received by dovetail groove 44. A nut 50 is threaded onto threaded end 49, securing dovetail tongue 45 in dovetail groove 44 of neck block 40.

Figure 6:
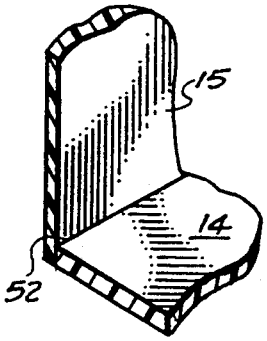
FIG. 6 is an enlarged fragmentary perspective view illustrating a joint of the body of the guitar.

Referring now to FIGS. 2 and 6, side 15 is generally affixed to back 14, followed by sound board 13 being positioned, and affixed to side 15 to complete body 12. Side 15 is affixed to back 14 by a bead of cement run along a juncture 52 between side 15 and back 14. Actual practice has shown that the so called fast acting, super strength glues which contain cyanoacrylate ester perform exceptionally well under the circumstances disclosed herein. Sound board 13 is affixed to side 15 by a similar bead of cement run along a juncture 53 between sound board 13 and side 15.

Figure 7:
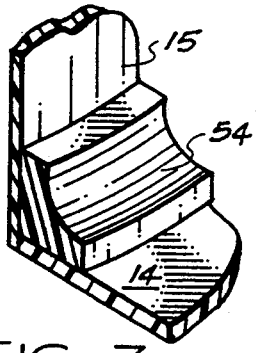
FIG. 7 is an enlarged fragmentary perspective view of an alternative joint used in the body of the guitar.
Figure 8:
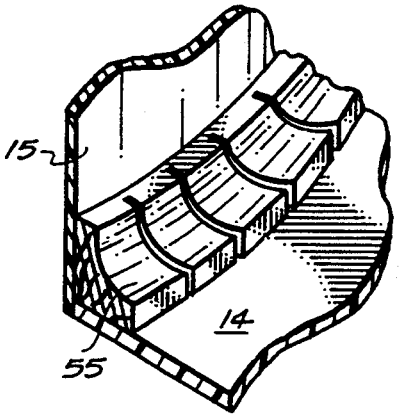
FIG. 8 is an enlarged segmentary perspective view of yet another alternate joint used in the body of the guitar.

As seen in FIGS. 6–8, alternate methods of joining back 14 and sound board 13 to side 15 may be used. FIG. 6 illustrates the use of a bead of adhesive run along junctures 52 and 53 as described above. FIGS. 7 and 8 illustrate the use of a cribbing such as plastic cove modeling 54 illustrated in FIG. 7. Molding 54 would be affixed to side 15 and sound board 13 or back 14 along junctures 52 and 53. Plastic molding 54 is sufficiently pliable to follow the contours of junctures 52 and 53. Alternatively, a kerfed cribbing 55 made of wood may be employed. Kerfed cribbing 55 may be wooden cove molding, kerfed to follow the contours of juncture 52 and 53. The cribbing, either plastic molding 54 of kerfed cribbing 55 is adhesively fastened to side 15 and back 14 to reinforce the adhesive in juncture 52. The aligning is also adhesively fastened to the inside of side 15 along its upper edge preparatory to receiving sound board 13.

Sound board 13 may be fabricated of melamine sheet material as discussed above, or of a selected wood such as spruce. In either event, sound board 13 is cut to match back 14 in constructing guitar 10. Adhesive is applied to the top surface of the cribbing and sound board 13 is placed so as to complete the enclosure of the body 12 of guitar 10.

Various changes and modifications to the embodiment herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

1. A hollow bodied string instrument comprising: a hollow body having;

a sound board having a neck end and a tail end, a back having a neck end and a tail end, a substantially continuous side coupling said sound board to said back in a generally parallel spaced apart relationship to enclose an interior, and affixing means for affixing said sidewall to said sound board and to said back to form an interior, at least one of said sound board, back and side composed entirely of melamine; impreganted resin impressed over phenolic craft papers and a neck coupled to said body.

2. An instrument as claimed in claim 1 wherein said neck includes:

an elongate member;

a head attached to a first end;

a heel attached to a second end; and attachment means for attaching said neck to said hollow body.

3. An instrument as claimed in claim 2 wherein said hollow body further includes:

a neck block coupled between said back and said sound board proximate said neck ends of each; and a tail block coupled between said back and said sound board proximate said tail ends of each.

4. An instrument as claimed in claim 3 wherein said attachment means includes:

a dovetail notch formed in said neck block; and a dovetail tongue formed in said heel receivable by said dovetail notch.

5. An instrument as claimed in claim 4, wherein said attachment means further includes an adhesive for retaining said dovetail tongue in said dovetail groove.

6. An instrument as claimed in claim 4 wherein said attachment means further includes an attachment member retaining said dovetail tongue in said dovetail groove.

7. An instrument as claimed in claim 4 wherein said affixing means includes an adhesive joining said sound board to said side along a first juncture formed therebetween, and said back to said side along a second juncture formed therebetween.

8. An instrument as claimed in claim 7 wherein said hollow body further includes a first cribbing extending around said interior of said hollow body following and reinforcing said first juncture between said sound board and said side.

9. An instrument as claimed in claim 8 wherein said hollow body further includes a second cribbing extending around said interior of said hollow body following and reinforcing said second juncture between said back and said side.

10. An instrument as claimed in claim 9 wherein said first and second cribbing is plastic molding.

11. An instrument as claimed in claim 1 wherein said melamine impregnated resin mipressed over phenolic craft papers is formed into a sheet material.

12. An instrument as claimed in claim 11 wherein said back is cut from sheet material formed from melamine impregnated resin impressed over phenolic craft papers.

13. An instrument as claimed in claim 12 wherein said side is cut from sheet material formed from melamine impregnated resin impressed over phenolic craft papers.

14. An instrument as claimed in claim 13 wherein said sound board is cut from sheet material formed from melamine impregnated resin impressed over phenolic craft papers.

15. An instrument as claimed in claim 14 wherein said hollow body further includes a cribbing extending around the interior of said hollow body following and reinforcing a juncture between said sound board and said side.

16. An instrument as claimed in claim 15 wherein said cribbing is a plastic molding.

17. A method of fabricating a hollow bodied string instrument comprising the steps of:

providing a sheet formed entirely of melamine impregnated resin impressed over phenolic craft papers;

cutting at least one of a sound board, a back and a side from said sheet;

providing the others of said sound board, said back and said side; and forming a hollow body having an interior from said sound board, said back, and said sides.

18. A method as claimed in claim 17 wherein said step of providing the others of said sound board, said back and said side includes cutting them from a sheet formed entirely from melamine impregnated resin impressed over phenolic craft papers.

19. A method as claimed in claim 18 wherein the step of forming a hollow body includes the step of affixing said side between peripheries of said sound board and bottom so as to be substantially continuous.

20. A method as claimed in claim 19 wheein the step of affixing includes running a bead of adhesive along a first juncture formed between said sound board and said side, and along a second juncture formed between said back and said side.

21. A method as claimed in claim 20 wherein the step of affixing further includes:

extending a first cribbing around said interior of said hollow body following and reinforcing said first juncture between said sound board and said side; and extending a second cribbing around said interior of said hollow body following and reinforcing said second juncture between said back and said side.

22. A method as claimed in claim 21 wherein said first and second cribbing are plastic cove molding.

23. A hollow bodied stringed instrument wherein said hollow body comprises:

a sound board;

a back;

a substantially continuous side coupling said sound board to said back in a spaced apart relationship to enclose an interior; end at least one of said sound board, back and side composed entirely of melamine impregnated resin impressed over phenolic craft papers.

24. An instrument as claimed in claim 23 herein said back and side are formed entirely of melamine impregnated resin impressed over phenolic craft papers.

25. An instrument as claimed in claim 24 wherein said sound board is formed entirely of melamine impregnated resin impressed over phenolic craft papers.

* * * * *